US009422722B2

(12) United States Patent
Iannelli

(10) Patent No.: US 9,422,722 B2
(45) Date of Patent: Aug. 23, 2016

(54) MESH GUTTER COVER

(71) Applicant: Anthony M. Iannelli, Cincinnati, OH (US)

(72) Inventor: Anthony M. Iannelli, Cincinnati, OH (US)

( * ) Notice: Subject to any disclaimer, the term of this patent is extended or adjusted under 35 U.S.C. 154(b) by 0 days.

(21) Appl. No.: 14/711,889

(22) Filed: May 14, 2015

(65) Prior Publication Data

US 2015/0330085 A1 Nov. 19, 2015

Related U.S. Application Data

(60) Provisional application No. 61/994,418, filed on May 16, 2014.

(51) Int. Cl.
*E04D 13/076* (2006.01)
*E04D 13/064* (2006.01)

(52) U.S. Cl.
CPC ..... *E04D 13/076* (2013.01); *E04D 13/064* (2013.01); *E04D 13/0767* (2013.01)

(58) Field of Classification Search
USPC ..... 52/12
See application file for complete search history.

(56) References Cited

U.S. PATENT DOCUMENTS 2,175,138 A * 10/1939 Westlake, Jr. ..... 52/12
2,175,521 A * 10/1939 Fry ..... 52/12
2,288,121 A * 6/1942 Sandmeyer et al. ..... 52/12
2,365,845 A * 12/1944 Schweda ..... 52/12
2,569,568 A * 10/1951 Lipshaw ..... 210/474
3,630,383 A * 12/1971 Reeves ..... 210/404
4,032,456 A * 6/1977 Berce ..... 210/474
4,404,775 A * 9/1983 Demartini ..... 52/12
4,841,686 A * 6/1989 Rees ..... 52/12
4,888,920 A * 12/1989 Marulic ..... 52/12
4,907,381 A * 3/1990 Ealer ..... 52/12
4,965,969 A * 10/1990 Antenen ..... 52/12
5,072,551 A * 12/1991 Manoogian, Jr. ..... 52/12
5,388,377 A * 2/1995 Faulkner ..... 52/11
5,438,803 A * 8/1995 Blizard, Jr. ..... 52/12
5,640,809 A * 6/1997 Iannelli ..... 52/12
5,729,931 A * 3/1998 Wade ..... 52/12
5,848,857 A * 12/1998 Killworth et al. ..... 405/118
5,893,240 A * 4/1999 Ealer, Sr. ..... 52/12
5,956,904 A * 9/1999 Gentry ..... 52/12
6,708,452 B1 * 3/2004 Tenute ..... 52/11
6,951,077 B1 * 10/2005 Higginbotham ..... 52/12
7,627,991 B1 * 12/2009 Feldhaus ..... 52/12
8,959,840 B1 * 2/2015 Oxley ..... 52/12
8,997,403 B1 * 4/2015 Steinberg et al. ..... 52/12
2001/0037610 A1 * 11/2001 Davis ..... 52/12
2003/0070366 A1 * 4/2003 Beyers ..... 52/12
2004/0255522 A1 * 12/2004 Knudson et al. ..... 52/11
2005/0155919 A1 * 7/2005 Swistun ..... 210/155
2005/0257432 A1 * 11/2005 Higginbotham ..... 52/12
2005/0274082 A1 * 12/2005 Welty ..... 52/120
2006/0101722 A1 * 5/2006 Ealer, Sr. ..... 52/12

(Continued)

*Primary Examiner* — Robert Canfield
(74) *Attorney, Agent, or Firm* — Frost Brown Todd LLC

(57) ABSTRACT

A gutter cover for a roof gutter includes a mesh screen, a roof attachment, a gutter attachment, and one or more ribs. The mesh screen is fashioned to extend longitudinally in overlying relation to a length of gutter and includes a rear edge and a front edge. The roof attachment is a sheet of metal or vinyl attached to the rear edge of the mesh screen. The gutter attachment is a sheet of metal or vinyl attached to the front edge of the mesh screen. A rib comprises a sheet of metal or vinyl attached to the mesh screen and is formed into one or more longitudinally extending ridges. In some embodiments, the gutter cover is made of plastic or metal.

19 Claims, 4 Drawing Sheets

(56) References Cited

U.S. PATENT DOCUMENTS

| | | | | |
|---|---|---|---|---|
| 2006/0123710 | A1* | 6/2006 | Lenney et al. | 52/12 |
| 2006/0179723 | A1* | 8/2006 | Robins | 52/11 |
| 2007/0234647 | A1* | 10/2007 | Higginbotham | 52/12 |
| 2010/0287846 | A1* | 11/2010 | Lenney | 52/12 |
| 2011/0056145 | A1* | 3/2011 | Lenney et al. | 52/12 |
| 2011/0067318 | A1* | 3/2011 | Lenney et al. | 52/12 |
| 2011/0138697 | A1* | 6/2011 | Martin | 52/12 |
| 2011/0138698 | A1* | 6/2011 | Neumann | 52/12 |
| 2011/0162289 | A1* | 7/2011 | Cangialosi | 52/12 |
| 2011/0185641 | A1* | 8/2011 | Snell | 52/12 |
| 2012/0110923 | A1* | 5/2012 | Robins | 52/12 |
| 2012/0132759 | A1* | 5/2012 | Sager | 248/49 |
| 2012/0233931 | A1* | 9/2012 | Ash et al. | 52/12 |
| 2013/0091780 | A1* | 4/2013 | Robins | 52/12 |
| 2013/0097943 | A1* | 4/2013 | Higginbotham | 52/12 |
| 2013/0152484 | A1* | 6/2013 | Horton | 52/12 |
| 2013/0160377 | A1* | 6/2013 | Sager | 52/12 |
| 2013/0160378 | A1* | 6/2013 | Higginbotham | 52/12 |
| 2014/0069028 | A1* | 3/2014 | Lenney | 52/12 |
| 2014/0223837 | A1* | 8/2014 | Pavlansky et al. | 52/12 |
| 2015/0020462 | A1* | 1/2015 | Iannelli | 52/12 |
| 2015/0040488 | A1* | 2/2015 | Lenney | 52/12 |
| 2015/0143756 | A1* | 5/2015 | Higginbotham | 52/12 |

* cited by examiner

MESH GUTTER COVER

PRIORITY

This application claims priority to U.S. Provisional Patent Application No. 61/994,418, entitled "Mesh Gutter Cover," filed on May 16, 2014, the disclosure of which is incorporated by reference herein.

BACKGROUND

Homeowners can periodically clean out their gutters by climbing atop the roof or standing on a ladder. As an alternative, products have been created to prevent leaves and other debris from entering the rain gutters, such as gutter covers. These allow water to flow into the gutter but prevent leaves and other debris from doing so by various methods. Some gutter cover use a mesh screen to prevent the leaves and other debris from entering the gutter. However, the mesh screens are not structurally strong enough without support being provided below them. In addition, many of the mesh screens are made from two different metals, which allow electrolysis to occur between the metals and rusting.

BRIEF SUMMARY

A gutter cover for a roof gutter comprises a mesh screen, a roof attachment, a gutter attachment, and one or more ribs. The mesh screen is fashioned to extend longitudinally in overlying relation to a length of gutter and comprises a rear edge and a front edge. The roof attachment is a sheet of metal or vinyl attached to the rear edge of the mesh screen. The gutter attachment is a sheet of metal or vinyl attached to the front edge of the mesh screen. A rib comprises a sheet of metal or vinyl attached to the mesh screen and is formed into one or more longitudinally extending ridges.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
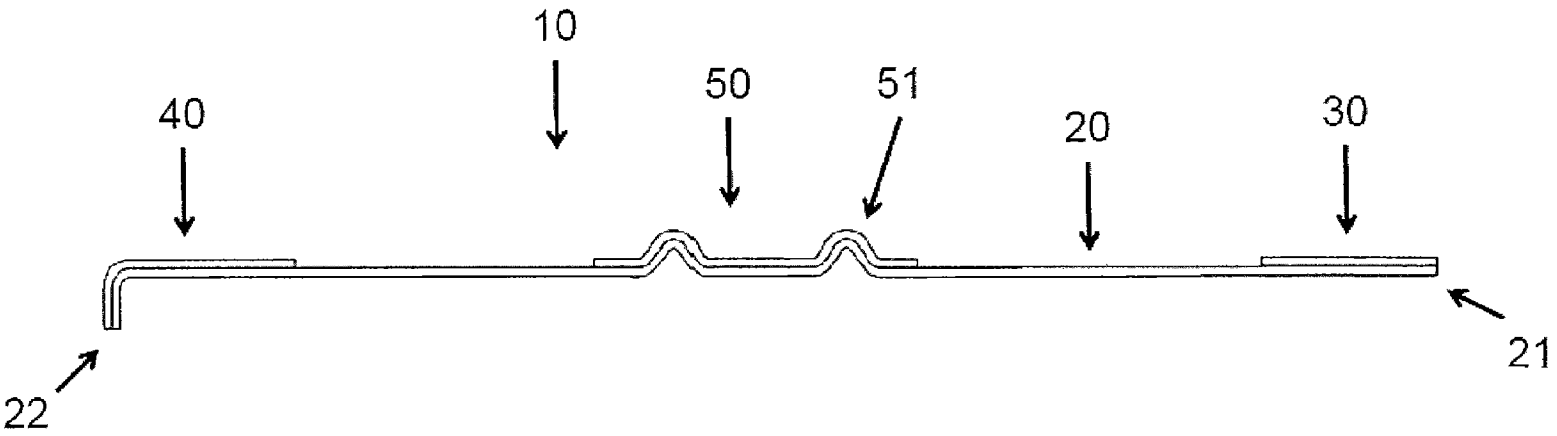
FIG. 1 is a cross section view of an embodiment of the gutter cover.

A gutter cover (10) for a roof gutter comprises a mesh screen (20), a roof attachment (30), a gutter attachment (40), and one or more ribs (50). The mesh screen (20) is fashioned to extend longitudinally in overlying relation to a length of gutter and comprises a rear edge (21) and a front edge (22). The roof attachment (30) is a sheet of metal or vinyl attached to the rear edge (21) of the mesh screen (20). The gutter attachment (40) is a sheet of metal or vinyl attached to the front edge (22) of the mesh screen (20). A rib (50) comprises a sheet of metal or vinyl attached to the mesh screen (20) and is formed into one or more longitudinally extending ridges (51). In some embodiments, the entire gutter cover is made of the same material such as plastic or metal, such as stainless steel or aluminum.

The mesh screen allows water to flow through the gutter cover and into the gutter while preventing leaves and other debris from doing so. The size of the openings and the thickness of the threads used to form the mesh screen (20) can be varied to change the flexibility of the mesh screen (20) or the size of the mesh. The mesh screen is formed from interwoven threads. In some embodiments, the interwoven threads defining the mesh screen comprise a plurality of stainless steel or aluminum threads. In some embodiments, the interwoven threads defining the mesh screen comprise a plurality of plastic threads. In some embodiments, the mesh screen has a mesh of from about 24 to about 280, such as from about 24 to about 30, about 30 to about 50, about 50 to about 80, and about 80 to about 280. In some embodiments, the diameter of the interwoven threads is between about 0.0015 inches and about 0.0055 inches.

Figure 2:
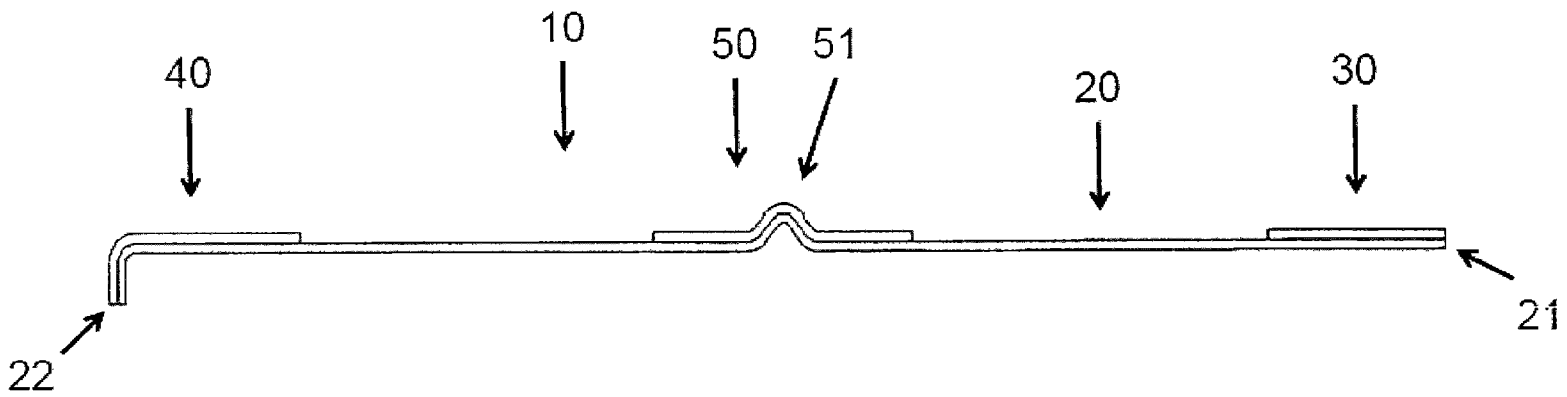
FIG. 2 is a cross section view of an embodiment of the gutter cover.
Figure 3:
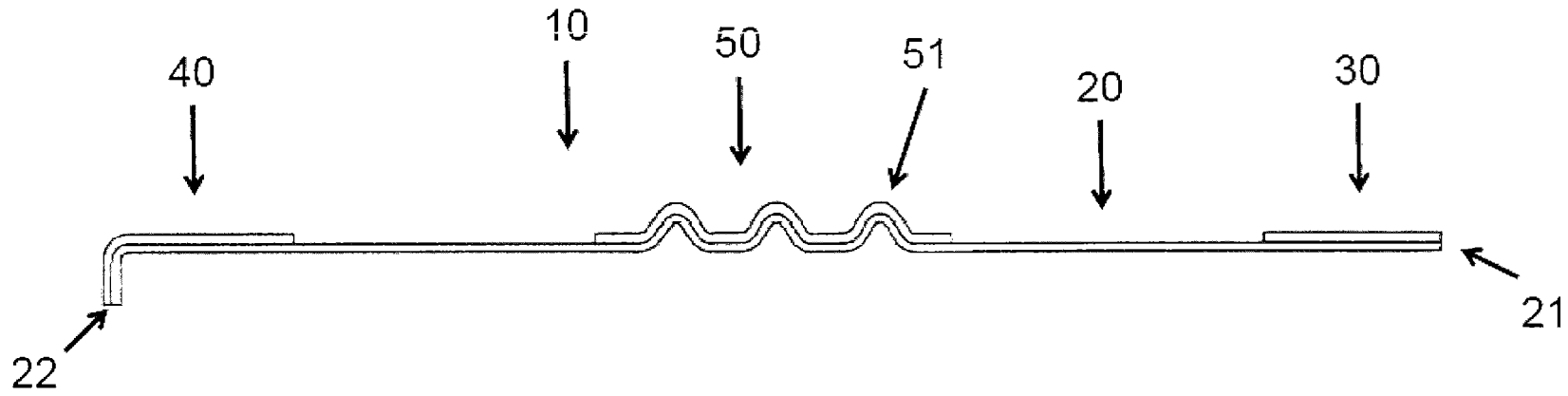
FIG. 3 is a cross section view of an embodiment of the gutter cover.
Figure 5:
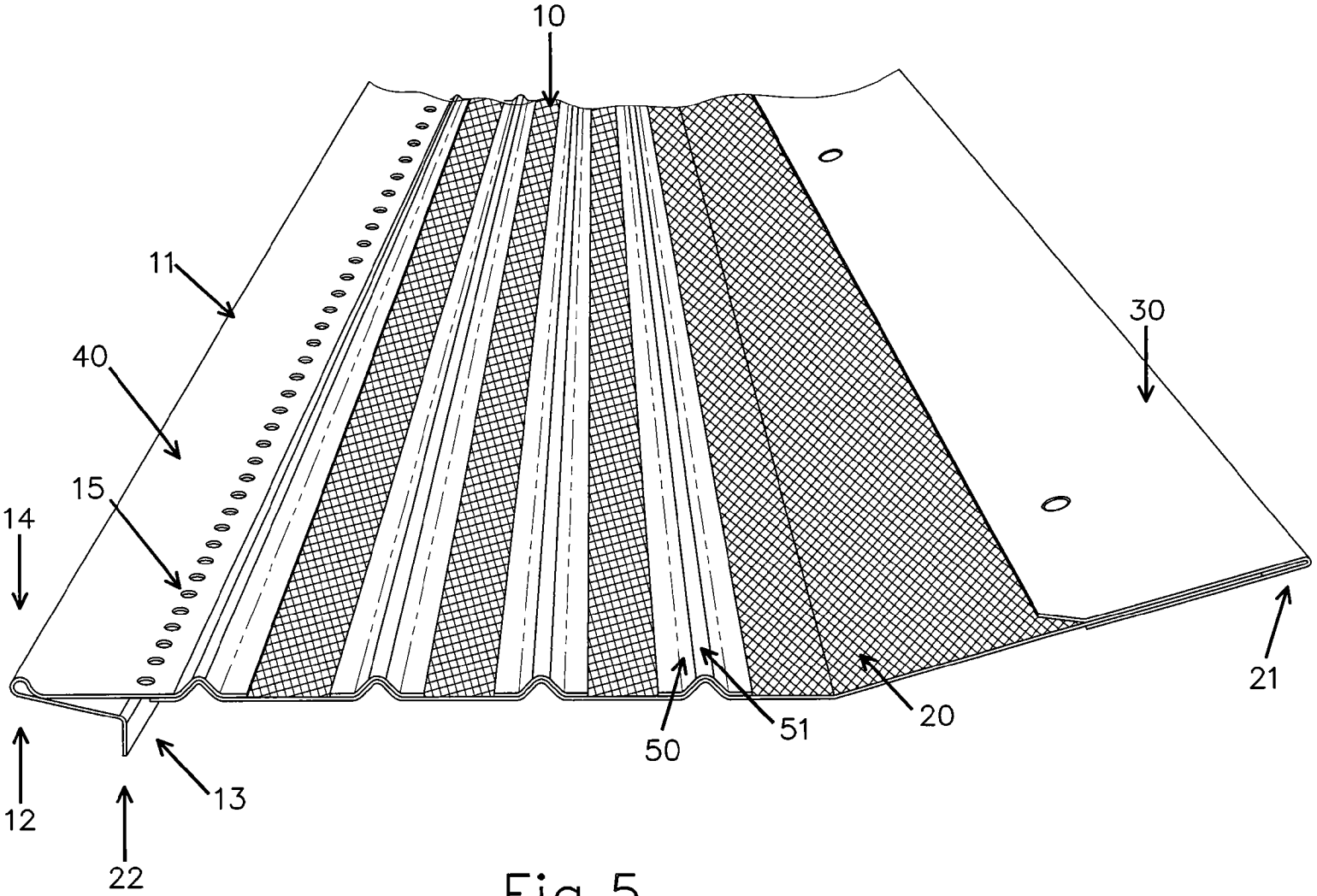
FIG. 5 is a top perspective view of the gutter cover of FIG. 4.

The roof attachment (30) is coupled with mesh screen (20) to reinforce rear edge (21) of mesh screen (20) to provide a sturdy portion to mount the rear edge (21) of the gutter cover (10) to the roof, typically under the shingles. The roof attachment is attached to the roof by a fastener, such as a nail or screw. The fastener passes through a hole in the roof attachment (30) to fasten the gutter cover (10) to the roof. The roof attachment (30) is made from a sheet of metal. In some embodiments the roof attachment (30) is welded to the mesh screen (20). Other suitable methods for coupling the roof attachment (30) to the mesh screen (20) will be apparent to one with ordinary skill in the art in view of the teachings herein, such as but not limited to adhesives, fasteners, etc. In some embodiments the roof attachment (30) is wrapped around the rear edge (21) of the mesh screen, as shown in FIG. 5. In some other embodiments the roof attachment (30) is aligned with the rear edge (21) of the mesh screen (20), as shown in FIGS. 1-3. Other suitable configurations for the roof attachment (30) will be apparent to one with ordinary skill in the art in view of the teachings herein. In some embodiments the roof attachment (30) comprises one or more longitudinally extending ridges (51).

The gutter attachment (40) is coupled with mesh screen (20) to reinforce the front edge (22) of the mesh screen (20) to provide a sturdy area to mount the front edge (22) of the gutter cover (10) to the front lip of the gutter. In some embodiments, the gutter attachment (40) is screwed to the front lip of the gutter, such as by zip screws. The gutter attachment (40) is made from a sheet of metal. In some embodiments the gutter attachment (40) is welded to the mesh screen (20). Other suitable methods for coupling the gutter attachment (40) to the mesh screen (20) will be apparent to one with ordinary skill in the art in view of the teachings herein, such as but not limited to adhesives, fasteners, etc.

In some embodiments the front end of the gutter attachment (40) is bent downwardly. As shown in FIGS. 1-3, the front end of the gutter attachment is aligned with the front edge (22) of the mesh screen (20) such that the mesh screen (20) is also bent downwardly to correspond to the gutter attachment (40). In some other embodiments, the front of gutter attachment (40) extends beyond the front edge (22) of the mesh screen (20). Accordingly, the front of the gutter attachment (40) is configured to engage the inside lip of the gutter to hold the gutter cover (10) on the gutter. Still other suitable configurations for the gutter attachment (40) will be apparent to one with ordinary skill in the art in view of the teachings herein.

In some embodiments, the gutter attachment (40) comprises a ledge (11) and a front rim (12). The ledge extends generally horizontally outwardly from the front edge (22) of the mesh screen (20) to the front rim (12). The front rim (12) of the gutter attachment (40) is bent rearward and extends generally horizontally inwardly underneath the ledge (11) to the clip (13). The clip (13) then extends downwardly from the front rim (23) and is fashioned to attach to the gutter (60). The clip (13) engages the inside lip of the gutter and holds the gutter cover (10) on the gutter (60). In some embodiments the front rim (12) additionally comprises a weir (14). In some embodiments, the gutter attachment (10) comprises one or more longitudinally extending ridges (51) between the ledge (11) and the front rim (12). In some embodiments gutter attachment (10) comprises holes (15) in the ledge (11), as shown in FIG. 5.

At least one rib (50) is attached with mesh screen (20) to reinforce and provide stiffness to the mesh screen (20) and the gutter cover (10) at selected areas. A rib (50) is a thin, long piece of sheet metal attached to the mesh screen (20) in a desired area between the rear edge (21) and the front edge (22) of the mesh screen (20). The rib (50) can be attached to the top of the mesh screen (20) or below the mesh screen (20). The rib (50) is typically made from the same metal as the mesh, such as plastic, aluminum, or stainless steel. The rib (50) is sufficiently rigid to provide reinforcement to the mesh screen (20). The rib (50) is welded to the mesh screen (20). In some embodiments the rib (50) is continuously welded to the mesh screen (20). In some embodiments the rib (50) is spot welded to the mesh screen (20). Other suitable methods for attaching the rib (50) to the mesh screen (20) will be apparent to one with ordinary skill in the art in view of the teachings herein, such as but not limited to adhesives, fasteners, etc. In some embodiments, the rib (50) further comprises openings to allow water to drain through the rib (50).

In some embodiments, there is one rib, two ribs, three ribs, or any other suitable number of ribs to provide selective reinforcement to the mesh screen (20). The ribs (50) only cover a portion of the mesh screen (20). A rib (50) comprises at least one longitudinally extending ridge (51). In some embodiments, there is one ridge, two ridges, three ridges, or any other suitable number of ridges extending longitudinally ridges on at least one rib (50). A ridge is a raised portion of the rib. It is raised in relation to both sides of ridge (51), which are planar or nearly planar. Accordingly, the ridge (51) is configured to divert water towards mesh screen (20) to allow the water to drain through the mesh screen (20). While FIGS. 1-3 show the ridge (51) as having a curved profile, but any other suitable shape for ridge (51) may be used. In some embodiments, the ridge (51) is flat on top, has a dimple, or is has a peak on top. FIGS. 1-3 further show the mesh screen (20) as having ridges that correspond to ridges (51) of rib (50). In some other embodiments, the mesh screen (20) is substantially flat such that ridges (51) of rib (50) extend away from the mesh screen (20). Still other suitable configurations for ridges (50) will be apparent to one with ordinary skill in the art in view of the teachings herein.

FIGS. 1-3 depict a gutter cover (10) comprising a mesh screen (20), a roof attachment (30), a gutter attachment (40), and one rib (50). In FIG. 1, there are two longitudinally extending ridges (51) on the rib (50). In FIG. 2, there is one longitudinally extending ridge (51) on the rib (50). In FIG. 3, there are three longitudinally extending ridges (51) on the rib (50). Of course, any other suitable number of ribs (50) and/or ridges (51) can be used as will be apparent to one with ordinary skill in the art in view of the teachings herein.

Figure 4:
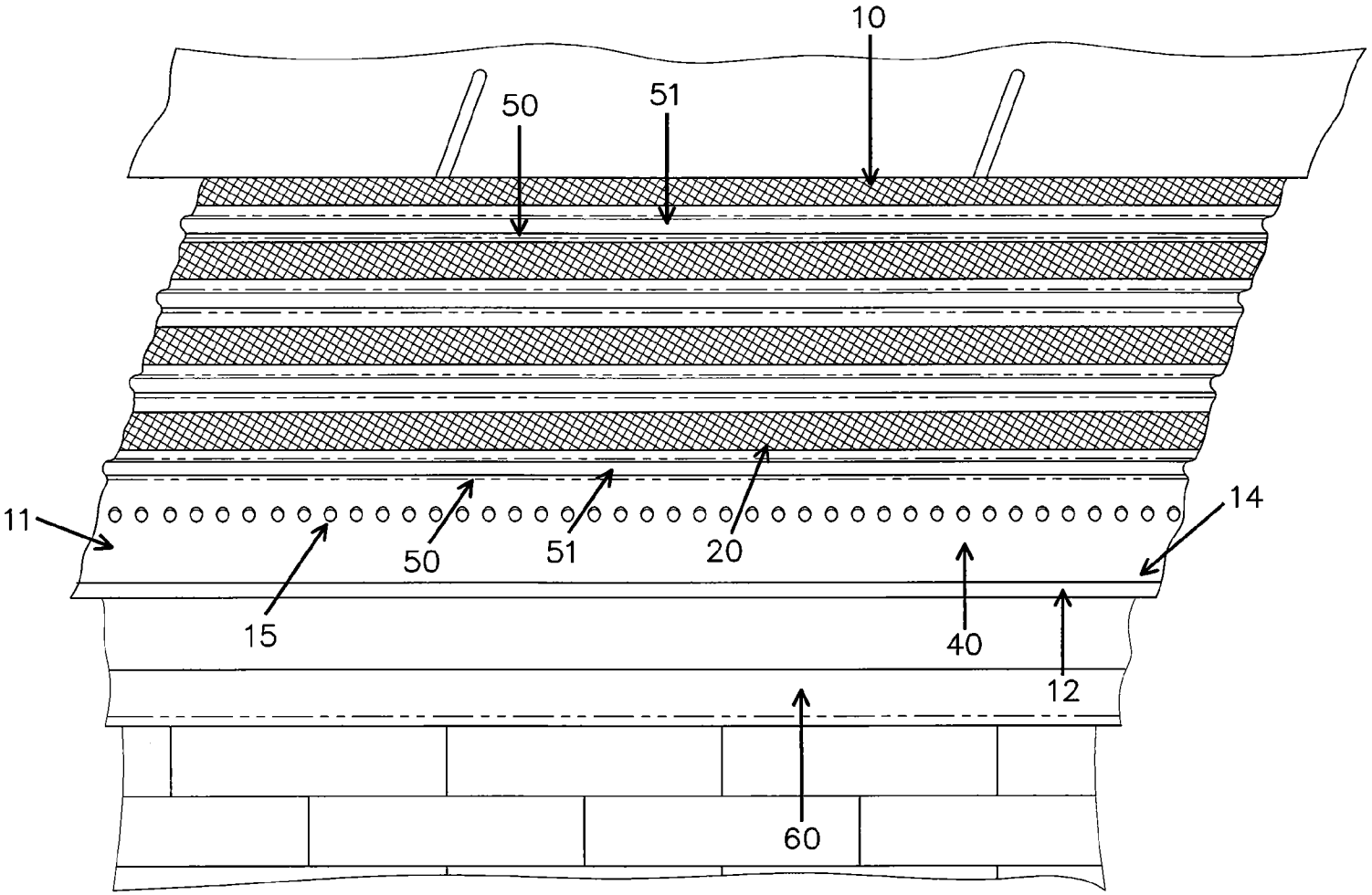
FIG. 4 is a top perspective view of an embodiment of the gutter cover mounted on a gutter.

FIG. 4 depicts the gutter cover (10) installed on a gutter (60). The roof attachment (30) is attached to the roof under the shingles. The gutter attachment (40) is clipped onto the inside lip of the gutter (60). The gutter cover (10) has three ribs (50), each with a single longitudinally extending ridge (51).

FIG. 5 depicts the gutter cover (10) of FIG. 4, but not installed on a gutter. The gutter attachment (40) comprises a ledge (11) and a front rim (12). The ledge extends generally horizontally to the front rim (12). The front rim (12) of the gutter attachment is bent rearward underneath the ledge to the clip (13).

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A gutter cover for a roof gutter comprising a mesh screen, a roof attachment, a gutter attachment, and one or more ribs;

wherein the mesh screen is configured to extend longitudinally in overlying relation to a length of gutter and comprises a rear edge and a front edge;

the roof attachment is a sheet of metal attached to the rear edge of the mesh screen;

the gutter attachment is a sheet of metal attached to the front edge of the mesh screen;

the one or more ribs having a curved profile and comprised of a sheet of metal attached to the mesh screen and formed into one or more longitudinally extending ridges;

wherein each ridge congruently overlies or underlies the screen.

2. The gutter cover of claim 1, wherein the roof attachment is welded to the mesh screen.

3. The gutter cover of claim 1, wherein the roof attachment is wrapped around the rear edge of the mesh screen.

4. The gutter cover of claim 1, wherein the gutter attachment is welded to the mesh screen.

5. The gutter cover of claim 1, wherein the gutter attachment comprises a ledge and a front rim, wherein the ledge extends generally horizontally to the front rim, the front rim of the gutter attachment is bent rearward underneath the ledge to a clip, wherein the clip is configured to attach to the gutter.

6. The gutter cover of claim 5, wherein the front rim additionally comprises a weir.

7. The gutter cover of claim 5, wherein the gutter attachment comprises holes.

8. The gutter cover of claim 1, wherein at least one rib is welded to the mesh screen.

9. The gutter cover of claim 1, wherein the gutter cover comprises 2 to 3 ribs.

10. The gutter cover of claim 1, comprising 2 to 3 longitudinally extending ridges.

11. The gutter cover of claim 1, wherein the gutter cover is metal.

12. The gutter cover of claim 1, wherein the gutter cover is stainless steel.

13. A gutter cover for use with a roof gutter, wherein the gutter cover comprises:

a mesh screen extending longitudinally in overlying relation to a length of gutter, wherein the mesh screen comprises a rear edge and a front edge;

a roof attachment coupled with the rear edge of the mesh screen;

a gutter attachment coupled with the front edge of the mesh screen;

at least one rib coupled with the mesh screen between the rear edge and the front edge of the mesh screen, wherein the at least one rib comprises at least one longitudinally extending ridge; wherein the ridge congruently overlies or underlies the screen; and wherein the at least one rib comprises a curved profile.

14. The gutter cover of claim 13, wherein the roof attachment comprises a sheet of metal configured to attach the gutter cover with a roof.

15. The gutter cover of claim 13, wherein the gutter attachment comprises a sheet of metal configured to attach the gutter cover to a gutter.

16. The gutter cover of claim 13, wherein the at least one rib comprises a sheet of metal configured to selectively reinforce a portion of the mesh screen.

17. The gutter cover of claim 13, wherein the at least one rib is vinyl.

18. The gutter cover of claim 1, wherein at least one longitudinally extending ridge comprises a raised portion positioned between opposing planar sides.

19. The gutter cover of claim 13, wherein the mesh screen extends beyond the at least one rib on each edge of the at least one rib.

* * * * *